United States Patent [19]

Bannister

[11] Patent Number: 4,569,143

[45] Date of Patent: Feb. 11, 1986

[54] STRUCTURAL FRAME

[75] Inventor: Brian C. Bannister, North Mymms, England

[73] Assignee: Marler Haley ExpoSystems Limited, Barnet, England

[21] Appl. No.: 643,482

[22] Filed: Aug. 23, 1984

[30] Foreign Application Priority Data

Sep. 2, 1983 [GB] United Kingdom ..... 8323601

[51] Int. Cl.[4] ..... G09F 17/00

[52] U.S. Cl. ..... 40/603; 40/605; 211/198; 211/199

[58] Field of Search ..... 40/603, 605; 52/65, 52/222, 273; 211/198, 199, 189, 195; 160/135, 351; 403/342

[56] References Cited

U.S. PATENT DOCUMENTS

| | | | |
|---|---|---|---|
| 2,790,258 | 4/1957 | Freshour | 40/605 |
| 2,940,606 | 6/1960 | Kurnitz | 40/605 |
| 4,046,481 | 9/1977 | Horvath | 403/342 |
| 4,404,962 | 9/1983 | Zinn et al. | 52/222 |

FOREIGN PATENT DOCUMENTS

| | | | |
|---|---|---|---|
| 1932 | of 1896 | United Kingdom | 211/199 |

*Primary Examiner*—Gene Mancene
*Assistant Examiner*—Cary E. Stone
*Attorney, Agent, or Firm*—Parmelee, Miller, Welsh & Kratz

[57] ABSTRACT

A display device comprises a plurality of frames each comprising two uprights and two cross members, bounding a rectangular space in which a rectangular flexible sheet is supported in tension by tensioning devices displaced in the corners of the frame. Laterally adjoining frames are pivotally connected together by links and engage one another via masking gear segments mounted on the tensioning devices. Vertically superimposed frames are connected together by connectors each connecting, end to end, the lower end of one upright of an upper frame and the axially aligned upper end of a lower frame. Each connector comprises an upper peg, a lower peg and an axially slidable and rotatable sleeve captive on the upper peg and capable of being screwed down over the lower peg.

8 Claims, 10 Drawing Figures

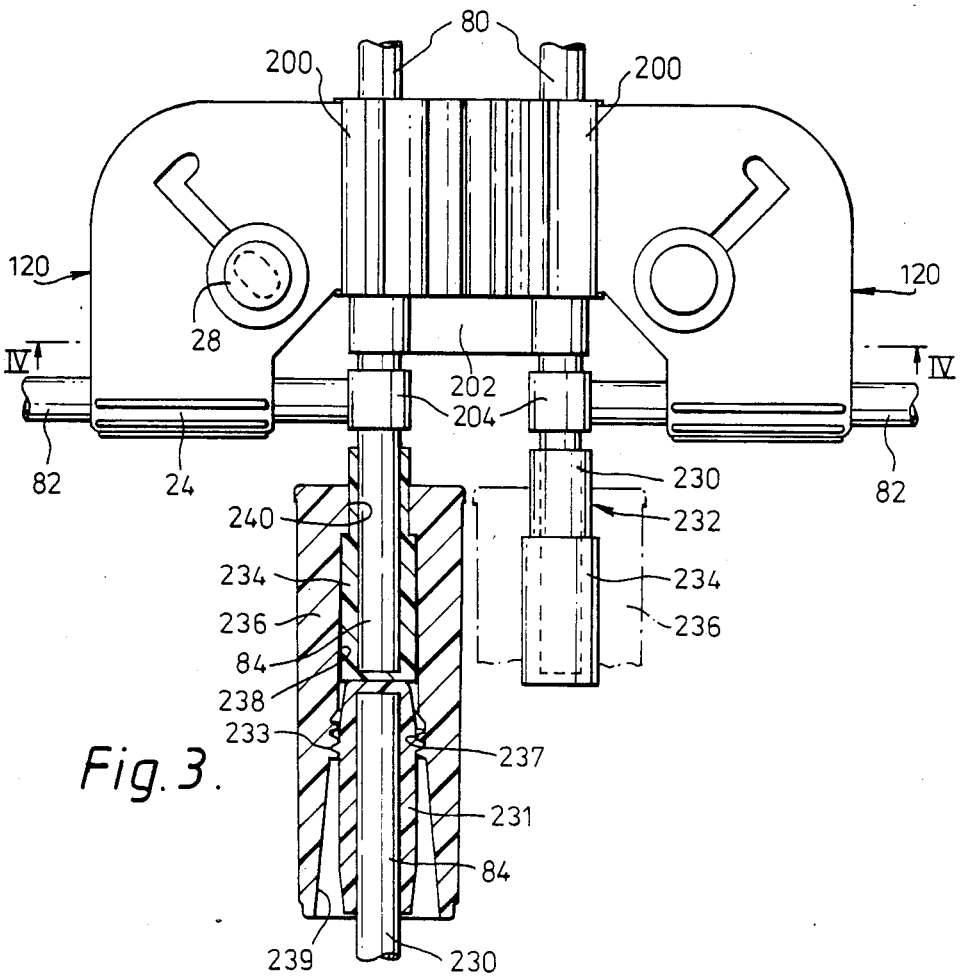
Fig. 3.
Fig. 4.
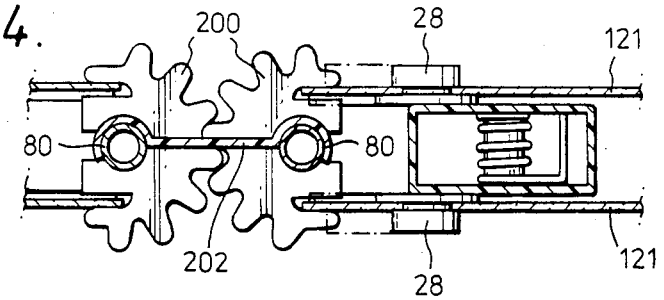

STRUCTURAL FRAME

BACKGROUND OF THE INVENTION

This invention relates to a device including a frame bounding a space and incorporating means for supporting a display sheet or the like, for example a device which may be incorporated in a sectional screen such as may be used, for example, in exhibitions and the like.

Our U.K. Pat. No. 1542245 discloses a screen in which adjoining sections, in the form of rectangular panels, are pivotally connected edge to edge through the intermediary of inter-meshing gear segments. Co-pending U.S. patent application Ser. No. 582,630 of J. N. Morgan (and the corresponding European Patent Publication No. 0119762) discloses sheet-tensioning devices which can be fitted on the corners of a rectangular frame to support the corners of a flexible display sheet or the like extended across the frame and to tension the sheet.

It is among the objects of the present invention to provide a device affording the advantages both of that disclosed in our U.K. Pat. No. 1542245 and that disclosed in co-pending U.S. patent application Ser. No. 582,630.

SUMMARY OF THE INVENTION

According to one aspect of the invention there is provided a device including a frame bounding a space, said frame comprising an elongate member or members extending around the periphery of said space, and a flexible sheet extended across said space and supported in a tensioned condition by means of tensioning devices carried by the frame, at least one said sheet-tensioning device including a body having means engaging a said elongate peripheral member of said first frame and a sheet-engaging element mounted in said body for movement towards and away from said means, said means providing or carrying, externally, a gear segment meshing with a gear segment carried by a side of a frame or panel adjoining said elongate peripheral member engaged by said means, and connecting means pivotally connecting the first mentioned frame and the adjoining frame or panel, the arrangement being such that the first-mentioned frame and the adjoining frame or panel can be moved angularly relative to one another, and to said connecting means whilst said gear segments on said body and said adjoining panel or frame roll in mesh with one another.

It is an object of another aspect of the invention to provide a device comprising a generally rectangular peripheral frame having means whereby it can be readily and reliably interconnected with identical devices in vertical array.

According to this aspect of the invention there is provided a device comprising a generally rectangular peripheral frame comprising spaced-apart side members connected by cross members, the side members projecting, at either end, beyond the cross-members, and wherein each said side member carries, at one end thereof, a sleeve adapted to receive the end, not so provided, of an identical side member, whereby two or more such side members of different frames can be connected end to end.

An embodiment of the invention is described below by way of example with reference to the accompanying drawings.

BRIEF DESCRIPTION OF DRAWINGS

FIG. 3 is an elevation view, to an enlarged scale, of part of the sectional frame of FIG. 1, FIG. 4 is a view in horizontal section along the line IV—IV of FIG. 3.

DESCRIPTION OF PREFERRED EMBODIMENT

Figure 1:
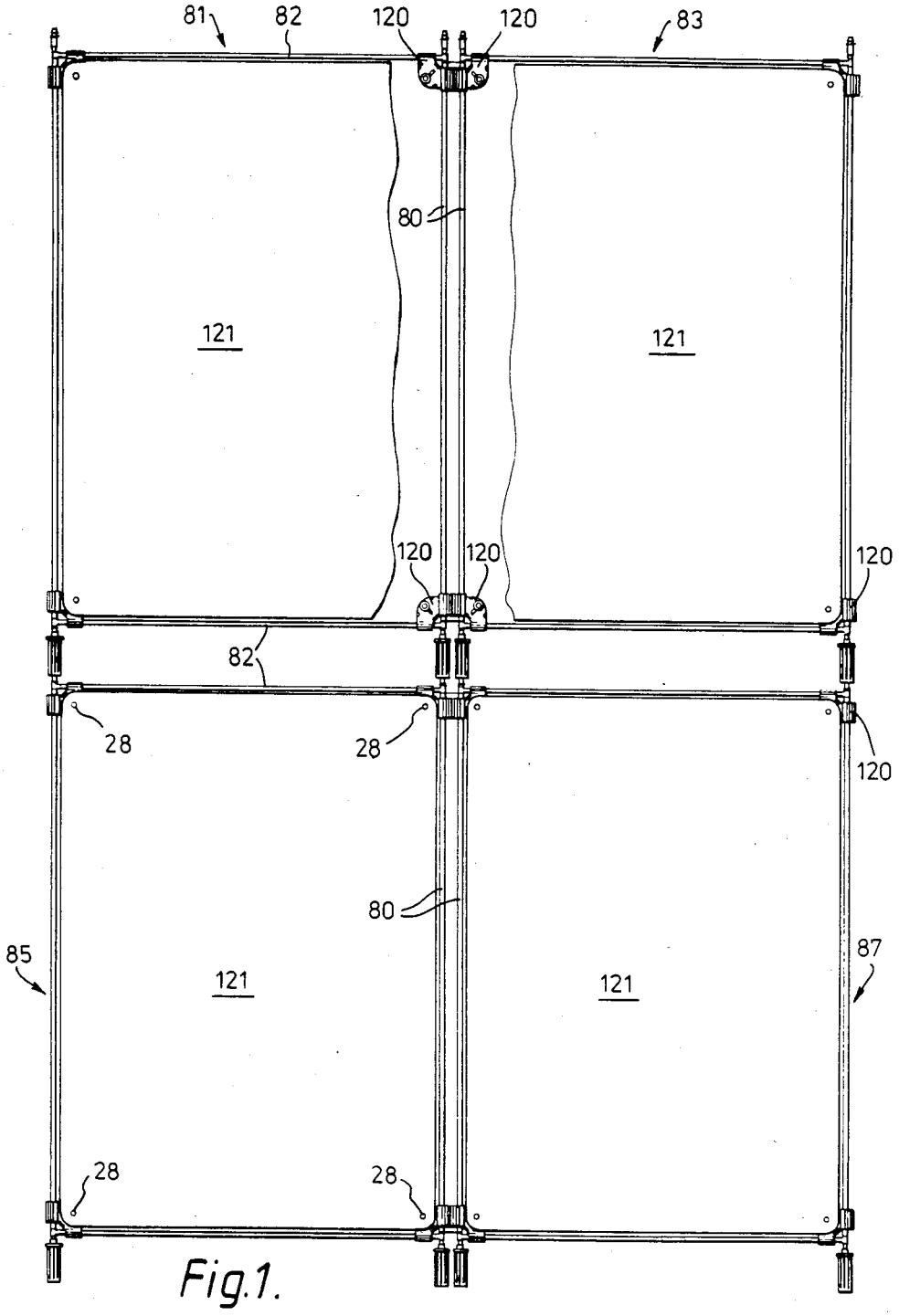
FIG. 1 is a side elevation view, with parts broken away, illustrating a sectional frame embodying the invention.

Referring to FIG. 1, there is shown, schematically, a sectional screen having four sections each in the form of a rectangular metal frame comprising vertical elongate side members 80 connected adjacent upper and lower ends thereof by elongate cross-members 82. The four frames are referenced 81, 83, 85 and 87 in FIG. 1. Each said section or frame is, in practice, of the form disclosed in our U.K. Pat. No. 1586738, so that the portions of the side members 80 lying between the upper and lower cross members are constituted by straight metal tubes, with each cross member 82 carrying at each end a respective end fitting providing a respective boss portion 204 (FIG. 3) co-axial with, and abutting the end of, the respective vertical tubular side member 80, said boss portion 204 having a spigot (not shown) fixed within the respective end of the respective vertical tubular member and a respective limb projecting in the opposite direction from said spigot. One such limb is indicated at 84 in FIG. 3.

In each corner of each of the rectangular frames 81, to 87 is disposed a respective sheet-tensioning device 120 of the kind described in our co-pending European Patent Application No. 84301117.2 to which reference should be had for a more complete description of such a device. The sheet tensioning devices of each frame incorporate sleeve portions 24 engaging the respective frame members 80, 82 and also incorporate members 28 (FIG. 3) which engage in apertures provided in the corners of a rectangular display sheet 121 of flexible material fitted to the respective frame, in a manner described in detail in European Patent Application No. 84301117.2, the members 28 being movable towards and away from the sleeve portions 24 of the respective devices 120 and being spring-biased away from the sleeve portions 24 to tension the sheets 121 across the respective frames. For purposes of illustration, the display sheets 121 in the upper rectangular frames 81 and 83 in FIG. 1 are illustrated only partially.

In the screen, as the frames 81 to 87 are arranged with their side members 80 vertical, the members 80 are all parallel with one another. Laterally adjacent rectangular frames of the screen, such as frames 81 and 83, are pivotally connected, side member 80 to a side member 80, for pivoting about vertical axes, in a manner somewhat similar to that described in our U.K. Pat. No. 1542245 and which manner is described in greater detail below.

Figure 2:
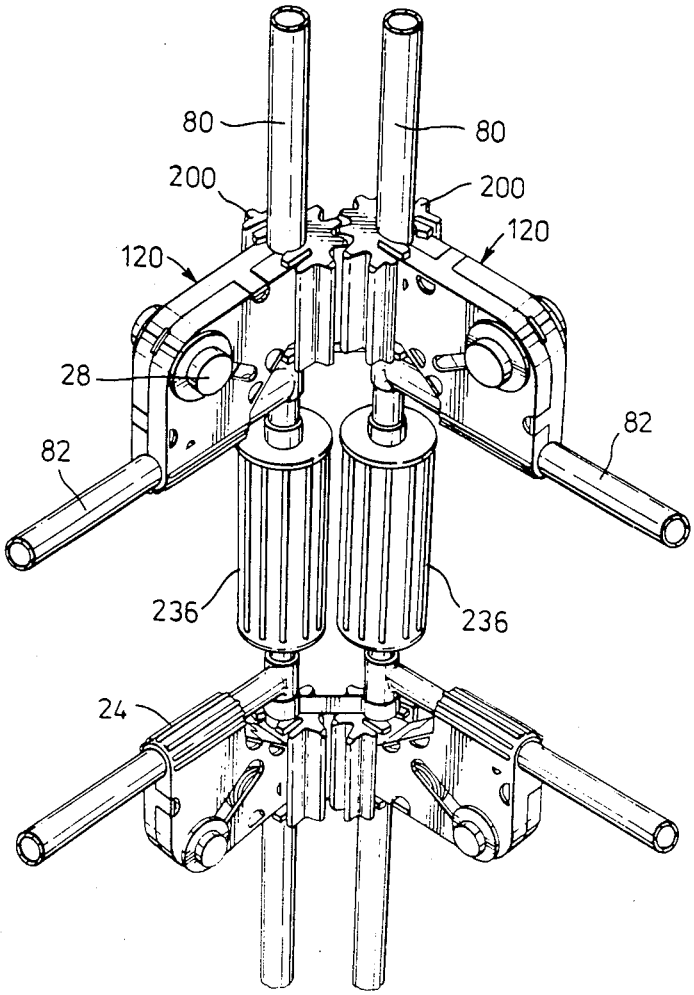
FIG. 2 is a perspective view of a detail of the frame.

Referring to FIG. 3, which is a detailed view to an enlarged scale showing the lower adjacent corner regions of the two laterally adjacent pivotally interconnected frames 81 and 83, each tensioning device 120 affords, extending at right angles to one another, two sleeves 24 through which extend, as a snug fit, respect ones of the upright 80 and the cross member 82 of the respective frame in the region of the respective corner in which that upright 80 and cross member 82 meet at right angles. Fitted over the sleeve 24 of the device 120 which is engaged around the respective upright 80 in the corner, illustrated in FIG. 2, of frame 81, is a gear segment 200 having, as its rotary or rolling axis, the central axis of the respective member 80. The gear segment 200 meshes with an identical gear segment carried by the adjacent tensioning device 120 carried by the adjacent frame 83. Said identical gear segment is mounted on the respective sleeve 24 of the last-noted tensioning device 120 which receives the respective upright 80 of frame 83.

Figure 5:
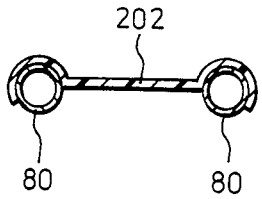
FIG. 5 is a diagrammatic sectional view illustrating a connecting clip.

In the arrangement illustrated in FIG. 1, a first pair of such meshing gear segments 200 is carried by the respective tensioning devices 120 at the respective adjacent lower corners of the two frames 81 and 83 and a further pair of meshing gear segments 200 are likewise carried by the tensioning devices 120 at the respective adjacent upper corners of the two frames 81 and 83. The adjacent side members 80 of the adjacent frames 81 and 83 connected with one another by means of connecting members in the form of two clips 202 each of which is engaged around the two adjacent side members 80 of the frames 81 and 83, one such clip 202 being at a position immediately below the junctions of said adjacent side members 80 with respective boss portions 204 of the end fittings of the upper cross members of the two frames 81 and 83 and the other clip 202 being at a position immediately above the junction of said adjacent side members with respective boss portions 204 of the end fittings of the lower cross members of the frames 81 and 83. As will be noted, each device 120 stops short of the vertex of the corner of the frame in which it is fitted so that there is defined, in the region of said vertex, a space, accommodating the respective clip 202, between the meshing gear segments 200 and the boss portions 204. As shown in section in FIG. 5, each clip, formed from resilient metal strip, comprises two arcuate portions, each extending over rather more than 180° around the respective side member 80 and a central web connecting the two arcuate portions, and thus connecting the side members 80 over which the arcuate portions are fitted. The side members 80 are a free rotatable fit within the arcuate portions when the latter are clipped over the members 80, so that each of the adjacent members 80 of the two frames 81, 83, and thus the respective frame 81, 83 of which it forms part, is pivotable with respect to the clip 202 about the longitudinal central axis of the respective member 80, the meshing gear segments 200 rolling, in mesh with one another, around one another during such pivotable movement, in the same manner as described, for example, in our U.K. Pat. Nos. 1542244 or 1542245.

Figure 6:
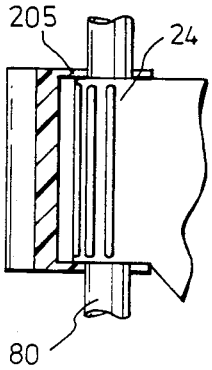
FIG. 6 is a diagrammatic view in longitudinal section, showing a gear segment applied to a sheet-tensioning device and frame member.
Figure 7:
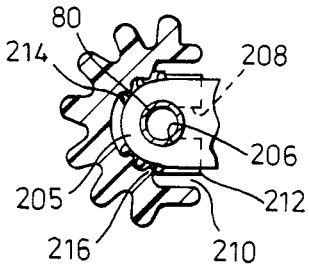
FIG. 7 is a diagrammatic view in cross section, corresponding to FIG. 5.
Figure 8:
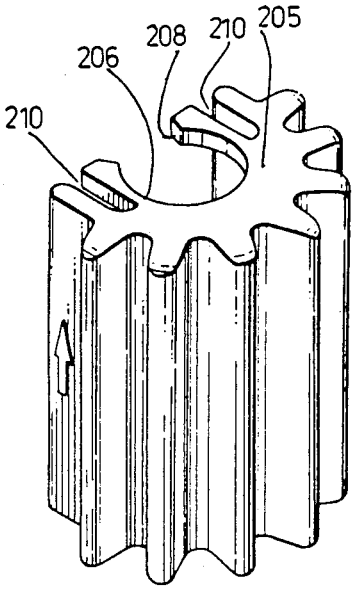
FIG. 8 is a perspective view of the gear segment member.
Figure 9:
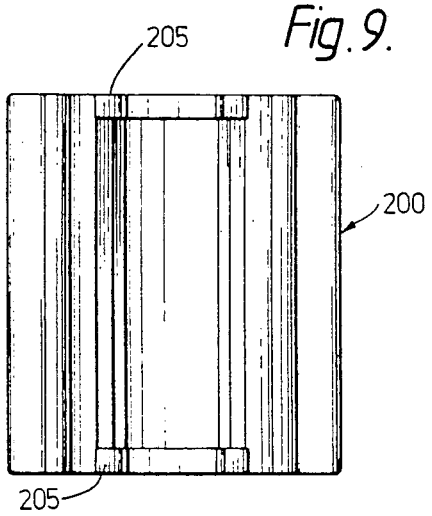
FIG. 9 is an elevation view showing the interior of the gear segment member.
Figure 10:
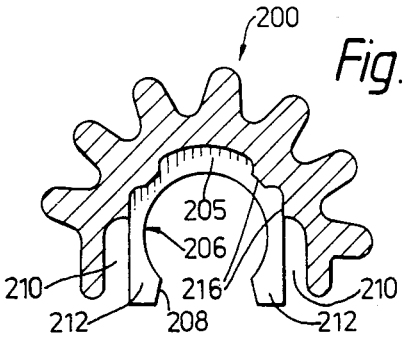
FIG. 10 is a view in cross-section of the gear segment member, corresponding to the view in FIG. 6, but with the tensioning member and frame upright omitted.

As shown in FIGS. 6 to 10, each gear segment 200, preferably formed of resilient plastics material, is in the form of a generally channel-shaped shell, providing, intermediate its ends, a major channel portion to receive the sleeve portion 24 of the device over which it is clipped, the gear segment having at either end thereof a respective end wall 205 formed with a circular aperture 206 of reduced diameter as compared with the interior of the major channel portion, said aperture 206 being of a size to receive snugly the respective side member 80 (which is, of course, of smaller external diameter than the sleeve portion 24 which embraces the member 80). Each aperture 206 is intersected by a radial slot 208 extending from the edge of the respective end wall 205 which is exposed on the open side of the channel in the gear segment 200 which receives the sleeve portion 24 and each end wall 205 is further interrupted by slots 210 extending from the last noted edge of the end wall, generally parallel with the slot 208, along the inner surfaces of the side walls of the major channel portion, so that each end wall 205 provides resilient legs 212, each defined between the slot 208 and one of the slots 210, and which resilient legs can be sprung apart to allow entry of the respective side member 80 when the gear segment is clipped over the member 80 and sleeve portion 24 as shown in FIG. 6. The spacing, within the gear segment 200, between the opposing faces of the opposing end walls 205 is somewhat greater than the axial spacing between the opposite end surfaces of each sleeve portion 24 so that the gear segment 200, having its end walls 205 engaged around the portions of the member 80 projecting from the opposite ends of the sleeve portion 24, is located axially on the sleeve portion 24. The slots 210 may also, as shown in FIG. 4, receive the edge portions of the tensioned sheets 121 held in place by the tensioning devices.

In order to prevent rotational movement of the gear segment 200 on the sleeve portion 24 on which it is mounted, the exterior of the sleeve portion 24 is provided, at intervals therearound, with longitudinally extending ribs 214 between which fit complementary ribs 216 projecting radially inwardly from the arcuate internal surface of the major channel portion of the gear segment.

In order to allow the pivotally interconnected frames 81, 83 to be capable of assuming relative positions in which they are co-planar the gear segments 200 are not symmetrical about the central planes of the respective frames to which they are fitted, and therefore the orientation of the gear segments 200 on the tensioning devices 20 is significant. The gear segments 200 and the sleeve portions 24 are preferably provided with cooperating formations, for example an asymmetrical arrangement of the ribs 214 and 216, ensuring that it is not possible to fit a gear segment 200 upside down as viewed in FIG. 3.

It will be appreciated that the lower frames 85 and 87 in FIG. 1 are pivotally connected in the same way as the upper frames, and that further identical frames may be likewise pivotally connected with the other vertical edges of any of the frames 81 to 87.

The projecting lower end of each side member of the frames shown is formed by a peg 230, for example of plastics material, having an axially extending recess receiving the limb 84 of the respective end fitting when the peg 230 is fitted over that limb. Each peg 230 is substantially cylindrical and includes a minor portion 232 and an enlarged cylindrical end portion 234. Each peg 230 is fitted with a member 236 in the form of a generally cylindrical tubular sleeve, the internal passage through which includes a bore 240 which extends from the upper end of the sleeve to an intermediate cylindrical bore 238 of enlarged diameter relative to the bore 240, the axial passage through the sleeve including an internally screw-threaded portion 237 at the end of the bore 238 remote from bore 240, and a frusto-conically flaring bore portion 239 extending from the screw-threaded portion 237 to the lower end of the sleeve. The bore 240 is too small to allow the enlarged end portion 234 of the peg 230 to pass through but receives the portion 232 as a free sliding and rotating fit. The bore 238 receives the enlarged end portion 234 as a free sliding and rotating fit.

The projecting upper end of each side member of the frames shown is formed by a peg 231, also of plastics material having an axially extending recess receiving the limb 84 of the respective end fitting when the peg 231 is fitted over that limb. Each peg 231 is generally cylindrical, with frusto-conically tapering upper and lower ends. Just below the upper tapering end, each peg 231 has a screw thread 233 of a form complementary with that of the internally screw-threaded portion 237 of sleeve 236.

Each sleeve 236 is movable axially on its peg 230 between a retracted position (i.e. a raised position in FIG. 3), in which its free end (i.e. its lower end in FIG. 3) is substantially flush with the free end of the enlarged portion 234 of the peg 230 on which it is carried, and an extended position (ie. a lowered position in FIG. 3) in which it projects over the end portion 234 of the peg 230 on which it is carried.

The sleeve 236 serves to provide lateral location, relative to one another, of an upwardly projecting peg 231 of a lower frame, such as frame 85 and the axially aligned, superimposed, downwardly projecting peg 230, of an upper frame, such as frame 81, when two or more frames are arranged one above the other with side members 80 of the thus superimposed frames in axial alignment. Thus the upwardly projecting peg 231 of the lower frame (otherwise not shown in FIG. 3) is received within the sleeve 236 on the downwardly extending peg 230 of the upper frame, the sleeve 236 being in a downwardly extended position relative to the upper peg.

To secure the axially aligned pegs 230 and 231 together, the sleeve 236 is lowered over the peg 231 and is rotated, so as to screw the internally screw-threaded portion 237 over the external screw thread 233 of the peg 231 until the shoulder formed in the sleeve between the bore 238 and the bore 240 is firmly engaged with the shoulder formed on peg 230 between the portion 232 and the portion 234 and the upper end face of the peg 231 is held firmly against the lower end face of the peg 230.

In the arrangement shown in FIG. 3, the sleeves 236 are provided on the downwardly extending pegs 230 at the lower ends of the upper frames 81, 83 so that, if all frames are made identical, the pegs 231 projecting from the upper ends of the frames would be without such sleeves. Conversely, of course, the upwardly projecting pegs of the frames 81 to 87 could be provided with such sleeves and the downwardly projecting pegs of the upper frames left without.

The provision of the sleeves 236 make it unnecessary, when fitting the frames together vertically, to lower a frame being fitted into position whilst maintaining both side members 80 in correct alignment with the side members they are to connect with, as would be necessary if the frames were merely provided with fixed spigot and socket arrangements. This would be a task of some difficulty for a single person, unassisted, particularly where a complex assembly of interconnected frames was being constructed. With the slidable sleeve arrangement described it is possible for a single person to fit such a frame readily onto an already positioned frame by fitting the peg 230 at the end of one side member 80 onto the respective peg 231 below, extending the respective sleeve 236 to locate the already-fitted peg 230 laterally, then pivoting the frame as a whole about the axis of the already fitted peg 230 to bring the other upright into the desired alignment with the respective peg 230 below, with the respective sleeve 236 raised, before extending that sleeve 236 also, and subsequently tightening the connections between the frames by rotating the sleeves 236 to screw these firmly onto the pegs 231. This is, in practice a relatively easy procedure to follow, single handed.

It should be explained that, for purposes of illustration, the sleeves 236 and pegs 230 and 231 are shown substantially larger, in relationship to the components of the frames, then they actually are in practice, and this accounts for, e.g., the sleeves 236 appearing to be too long in the drawings to be raised sufficiently to bring their lower ends to the level of the lower ends of the pegs 230 on which they are mounted.

It will be appreciated that the gear segment arrangement described may be utilised without the peg and sleeve arrangement and vice-versa.

I claim:

1. A device including a first frame bounding a space having a periphery, said frame comprising elongate members extending around the periphery of said space, and a flexible sheet extended across said space, by a plurality of tensioning devices carried by the frame and supporting said flexible sheet in a tensioned condition, at least one said sheet tensioning device including a body having a formation receiving and extending around a said elongate peripheral member of said first frame and a sheet-engaging element mounted in said body for movement towards and away from said formation, the device further including a further frame adjoining said peripheral member and having a side, a gear segment carried by said side of said further frame, said formation carrying, externally, a gear segment meshing with said segment carried by said side of said further frame adjoining said elongate peripheral member received by said formation, and connecting means pivotally connecting said first frame and said further, adjoining frame, the arrangement being such that said first frame and said further adjoining frame can be moved angularly relative to one another, and to said connecting means, whilst said gear segment on said body and the meshing gear segment on said adjoining frame roll in mesh with one another, and wherein said gear segment carried by said formation is formed on a respective element detachably mounted on said formation.

2. The device of claim 1 wherein said first frame and said further adjoining frame are each in the form of a rectangular peripheral frame comprising elongate side members connected by elongate cross-members, said gear segment on each said frame substantially coaxial with one said side member of the frame, the respective said side members of the two frames being adjacent and substantially parallel with one another, said connecting means including a connecting member, connecting said side members and pivotable with respect to both said side members about the respective axes thereof.

3. The device of claim 2 wherein said side members project, at either end, beyond said cross-members, and in which each said side member carries, at one end thereof, a sleeve for receiving the end, not so provided, of an identical side member, whereby two or more such side members of different frames can be connected end to end.

4. The device of claim 3 wherein said sleeve is slidable longitudinally on the respective side member between an extended position in which it projects beyond the respective end of the respective side member and a retracted position in which it does not.

5. The device of claim 3 wherein inter-engageable screw threads are provided on the interior of said sleeves and on the ends, not provided with such sleeves, of the frame, whereby when two or more such side members of different said frames are so connected end to end, the respective said sleeves can be screwed over the respective frame ends received therein to clamp together, end to end, axially, the adjacent, axially aligned frame ends.

6. The device of claim 1 wherein said formation is in the form of a sleeve having a through bore receiving said elongate peripheral member and wherein said gear segment carried by said formation is in the form of a channel-shaped shell having end walls at opposite ends of the shell, and having a major channel portion, intermediate said end walls, receiving said formation, each said end wall having a free edge which is exposed on the open side of said channel-shaped shell, each said end wall having an opening in the form of an aperture intersected by a slot extending from the said free edge, said aperture being of a size and shape to receive as a close fit said peripheral member and substantially smaller than the external cross-section of said sleeve, said slot being narrower than said peripheral member whereby said gear segment can be fitted over said peripheral member and sleeve by snapping said ends walls over said peripheral member so that said sleeve is located within said major channel portion between said end walls.

7. The device of claim 6 wherein each said end wall has two further slots therethrough, on opposite sides of the slot which intersects the respective said aperture, said further slots defining respective resilient legs between said further slots and the respective said slot which intersects the respective aperture, to facilitate the resilient snapping of the gear segment over said peripheral member.

8. The device of claim 7 including a plurality of ribs extending longitudinally on the exterior of said sleeve, a plurality of grooves extending longitudinally on the interior of said major channel portion and receiving respective said ribs, said ribs and grooves being arranged asymmetrically whereby the gear segment can be fitted on said sleeve only one way round, said gear segment having gear teeth which are arranged slightly asymmetrically with respect to said channel-shaped shell.

* * * * *